US009862469B1

(12) United States Patent
Drozd et al.

(10) Patent No.: US 9,862,469 B1
(45) Date of Patent: Jan. 9, 2018

(54) BUOYANCY COMPENSATING UNDERWATER VEHICLE STRUCTURE AND METHOD

(71) Applicant: THE BOEING COMPANY, Chicago, IL (US)

(72) Inventors: Stephen L. Drozd, Chino Hills, CA (US); Geoffrey S. Richards, Irvine, CA (US); Ryan M. Greenfield, Lake Forest, CA (US); Jeffrey S. Lipari, Costa Mesa, CA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 15/348,357

(22) Filed: Nov. 10, 2016

(51) Int. Cl.
*B63G 8/22* (2006.01)
*B63G 8/00* (2006.01)

(52) U.S. Cl.
CPC ..... *B63G 8/22* (2013.01); *B63G 8/001* (2013.01); *B63G 2008/002* (2013.01)

(58) Field of Classification Search
CPC ..... B63G 8/22
USPC ..... 114/330, 321, 333, 337, 21.1, 21.2
See application file for complete search history.

(56) References Cited

U.S. PATENT DOCUMENTS 1,209,678 A * 12/1916 Davison ..... B63G 8/08 114/337
1,224,105 A * 4/1917 Davison ..... B63G 8/08 114/337
3,897,743 A * 8/1975 Schoonman ..... B63G 8/001 114/321
5,163,379 A * 11/1992 Chorley ..... B63G 6/00 114/125
5,675,117 A * 10/1997 Hillenbrand ..... B63G 8/28 114/21.2
5,786,545 A * 7/1998 Hillenbrand ..... F41F 3/10 114/21.2
6,158,370 A * 12/2000 French ..... B63G 8/22 114/121
6,871,610 B1 * 3/2005 Galliano ..... B63G 3/02 114/238
7,013,827 B2 * 3/2006 Harland-White ..... B63G 8/001 114/321
2008/0127878 A1 * 6/2008 Marion ..... B63B 43/12 114/337
2008/0264323 A1 * 10/2008 Gosling ..... B63G 8/08 114/330
2012/0291689 A1 * 11/2012 Goydin ..... B63G 8/22 114/333

* cited by examiner

*Primary Examiner* — Lars A Olson
*Assistant Examiner* — Jovon Hayes
(74) *Attorney, Agent, or Firm* — Toler Law Group, PC

(57) ABSTRACT

A buoyancy compensating structure including a plurality of tubes forming at least a portion of the payload structure, and a payload section provided within the payload structure. The payload section is configured to house a removable payload. The buoyancy compensating structure further includes a controller configured to regulate a flow of fluid into the plurality of tubes. The controller is configured to neutralize a buoyancy of the payload structure in response to a change in condition of the removable payload in the payload section.

20 Claims, 5 Drawing Sheets

BUOYANCY COMPENSATING UNDERWATER VEHICLE STRUCTURE AND METHOD

BACKGROUND

The present disclosure relates to a buoyancy compensating structure that may be used in an underwater vehicle, and a method for compensating the buoyancy of a payload structure.

Maintaining a particular buoyancy is a goal for underwater vehicles, as operating at a near neutral buoyancy can allow underwater vehicles to operate most efficiently. In situations where underwater vehicles are configured to deploy items from the underwater vehicle to the water, or to acquire an item from the water for inclusion into the underwater vehicle, or even to move items to different locations in an underwater vehicle, there may be an inherent change in buoyancy of the underwater vehicle. Such items may include anything needing to be deployed, including but not limited to transponders, sensors and floating or sinking capsules.

It is desirable to provide a buoyancy compensation structure that allows for any buoyancy change in an underwater vehicle to be appropriately offset using a system that can provide structural integrity to the payload structure, without unduly limiting the amount of space in a payload structure for housing of items to be deployed. Such a structure can allow for buoyancy compensation to account for payload release of items that are heavy or light in water, and incorporate such a capability within the structure itself so as to maximize a large and continuous volume for the actual payload to be deployed or received.

SUMMARY

In some examples, a buoyancy compensating structure is provided. The buoyancy compensating structure includes a plurality of tubes forming at least a portion of the payload structure, and a payload section provided within the payload structure. The payload section is configured to house a removable payload. The buoyancy compensating structure further includes a controller configured to regulate a flow of fluid into the plurality of tubes. The controller is configured to neutralize a buoyancy of the payload structure in response to a change in condition of the removable payload in the payload section.

In some examples, a buoyancy compensating structure is provided. The buoyancy compensating structure includes a plurality of substantially cylindrical tubes provided on opposing walls of the payload structure, a flow control system comprising a flow meter and at least one valve, and a payload section. The flow control system is operable to add and remove seawater to the plurality of cylindrical tubes. When a mass or weight distribution of the payload section changes, the flow control system operates so as to adjust a buoyancy of the payload structure to a predetermined level.

In some examples, a method for compensating buoyancy of a payload structure of a marine vessel is provided. The method includes providing a plurality of tubes forming at least a portion of the payload structure, and regulating, by means of a controller, a flow of fluid into the plurality of tubes. The controller is configured to neutralize a buoyancy of the payload structure in response to a change in condition of a removable payload housed in a payload section of the payload structure.

DETAILED DESCRIPTION

Figure 1:
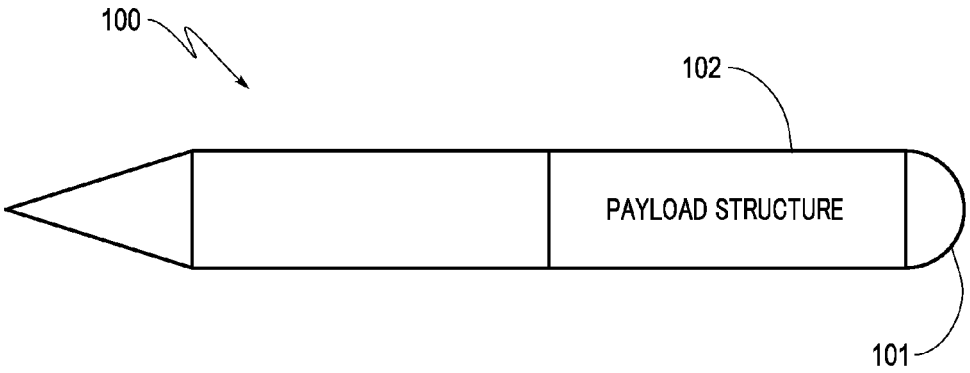
FIG. 1 is a schematic diagram of a marine vessel according to some examples.

The following detailed description of certain examples will be better understood when read in conjunction with the appended drawings. It should be understood that the various examples are not limited to the arrangements and instrumentality shown in the drawings.

Various examples provide for a buoyancy compensating structure and a method for compensating such buoyancy as they relate to an underwater vehicle or vessel. However, it should be appreciated that these examples can be used in different applications, such as applications not involving an underwater vehicle or an unmanned underwater vehicle. For example, the buoyancy compensation structure and methods may be used to neutralize buoyancy in a vehicle or device other than an underwater vehicle, such as a space vehicle, and accordingly, applications other than those involving underwater vehicles are contemplated.

FIG. 1 illustrates a structure of a vehicle 100. In some examples, the vehicle 100 can be an underwater vehicle, and also an unmanned underwater vehicle (UUV). In other examples, the vehicle 100 may be any vehicle or apparatus whereby a neutralization of buoyancy is desirable.

In the illustrated embodiment, the vehicle 100 includes a payload structure 102. The payload structure 102 is shown in FIG. 1 to be in the forward portion 101 of the vehicle 100. However, the location of the payload structure 102 with respect to the vehicle 100 is not limited, as the payload structure can otherwise be in the center, toward the front, at the front, or toward or at the back of the vehicle 100, or even above or below the vehicle 100. The payload structure 102 may further be an extension of the vehicle 100, for example, attached to a back portion of the vehicle 100. If a part of the vehicle 100 itself, the payload structure 102 may comprise any amount of the surface area of the vehicle 100, and in some embodiments may comprise from 10-70% of such surface area, or from 20-40% of such surface area, or about 30% of such surface area. The payload structure is generally located in the forward part of the vehicle to minimize pass-throughs of propulsion related equipment. However, it is possible to locate the payload structure in the aft end, or even adjacent to other portions/structures of the vehicle. Adjacency may be desirable, since the entire vehicle structure could also be buoyancy compensating structural tubes, and then the dynamic payload could be located anywhere within or around the vehicle.

Figure 2:
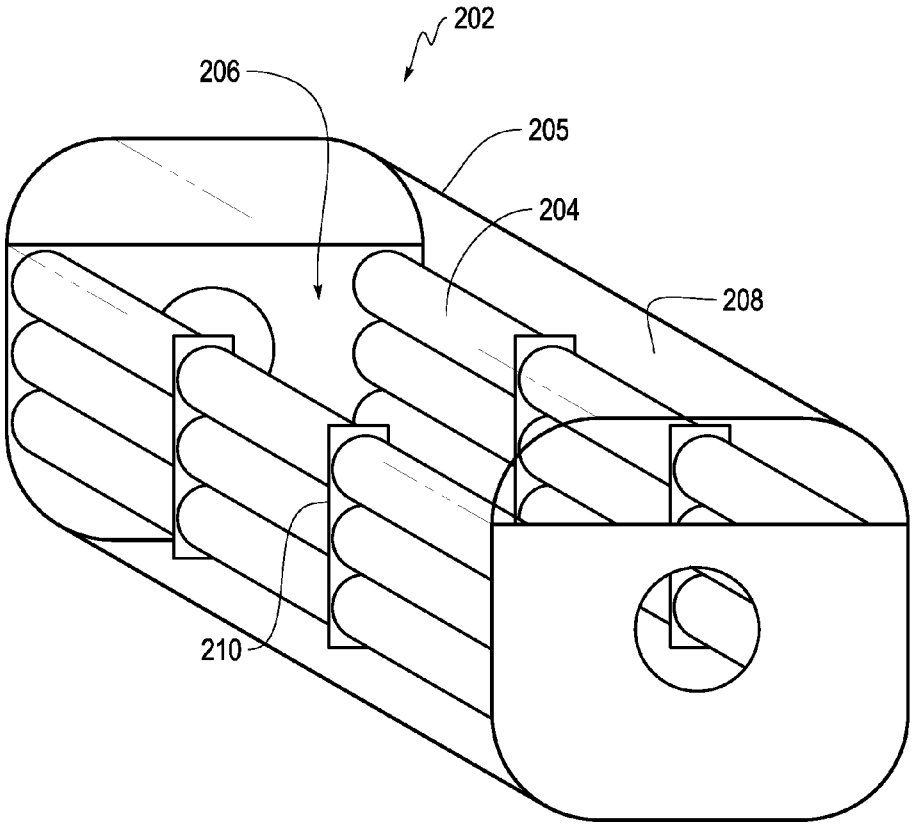
FIG. 2 is a diagram of a payload structure according to some examples.

FIG. 2 shows a configuration of the payload structure 202. Included in the payload structure 202 are a plurality of tubes 204 that are configured to hold or transfer an amount of fluid. The plurality of tubes 204 are provided at one or more locations (e.g., predefined locations) within the payload structure 202.

The plurality of tubes 204 may be generally hollow and designed to accommodate the shear and bending loads that would exist during a lifting process of the vehicle. The tubes 204 may also withstand a hydrostatic depth pressure, and can be flooded or drained to accommodate buoyancy changes of the payload, as discussed in more detail herein. The tubes 204 may be provided so as to withstand any necessary hydrostatic pressure that would occur based upon the traveling depth of the vehicle. Further, the plurality of tubes 204 are configured so as to receive a fluid or to expel a fluid so as to accommodate buoyancy changes that would occur in the vehicle due to the deployment, addition, or relocation of a payload.

In some examples, the plurality of tubes 204 are provided in a row-by-row arrangement, where the tubes 204 are stacked or arranged vertically on top of one another along an outside edge 205 of the payload structure 202. The number of rows of tubes 204 are not limited, and may be determined based upon flow control, structural, and support needs of the vehicle 100. In FIG. 2, three rows of tubes 204 are shown.

The plurality of tubes 204 may also be provided in a columnar nature, whereby tubes are linearly connected to others by any mechanical fastening means, such as hinges, screws and the like. The number of columns of tubes 204 are not limited, and may be determined based upon flow control, structural, and support needs of the vehicle. In FIG. 2, three columns of tubes are shown. It should be noted that each of the rows and columns of tubes 204 may have the same number of tubes 204 or a different number of tubes 204. Additionally, the size, shape and other configuration aspects of the tubes 204 may be varied as desired or needed.

In some examples, the plurality of tubes 204 are cylindrical or at least substantially cylindrical in nature. If substantially cylindrical, it is understood that the tubes will generally correspond to the shape of a cylinder, with the surface at least mostly traced by a straight line moving parallel to a fixed straight line and intersecting a fixed planar or generally closed curve. However, there may exist some slight deviations from a true cylinder, whereby the substantially cylindrical tubes would have a surface that is at least 90% or 95% round. Cylindrical tubes 204 may provide a benefit of improved efficiency in both bending and hydrostatic loading conditions. The tubes 204 may be configured so as to provide for structural integrity along both the starboard and port sides of the payload structure 202, while still allowing for efficient hydrostatic loading.

In some examples, the plurality of tubes 204 are located along one or more walls 208 of the payload structure 202, so as to effectively form a part of the payload structure 202 itself. Such a configuration may allow for multiple functionality of the tubes 204, whereby the tubes 204 can be provided to allow a fluid to be pumped therein or thereout so as to offset the buoyancy change that may occur in the vehicle 100, to act as a member to improve the rigidity and structural integrity of the payload structure 202 and/or vehicle 100 generally, as well as to act as pressure resistant variable ballast tanks in an orientation that will maximize the contiguous volume for payloads to be housed prior to deployment. That is, the structural tubes 204 incorporated into the payload structure 202 can provide the primary structure during vehicle handling (including lift and transportation) as well as operations (including hydrodynamic loading and wave slap).

Accordingly, the location of the plurality of tubes 204 may allow for the inclusion of a payload section 206 within the payload structure 202. The payload section 206 is provided within the payload structure 202 and is a space, that may be a large and continuous space, whereby an item to be deployed (e.g., a payload) can be housed. The payload section 206 may be significant in size.

The structural capabilities of the buoyancy compensating structure may be varied and dependent on the materials and conditions used. in some situations, the dynamically buoyant weight compensation capacity may be notional 10,000 pounds, the range of the vehicle used may be notional 600 miles, the depth may be notional 3,000 feet and the payload volume may reach a notional amount of 1150 cubic feet.

The length of the payload structure may be limited by the desired range/controllability of the vehicle. Increasing the length of the structure increases the volumetric capacity of the payload reservation, but reduces the range of the vehicle. This is depicted in the three images of differently sized notional payload structures 302, 402, 502 above as shown in FIGS. 3-5.

Figure 3:
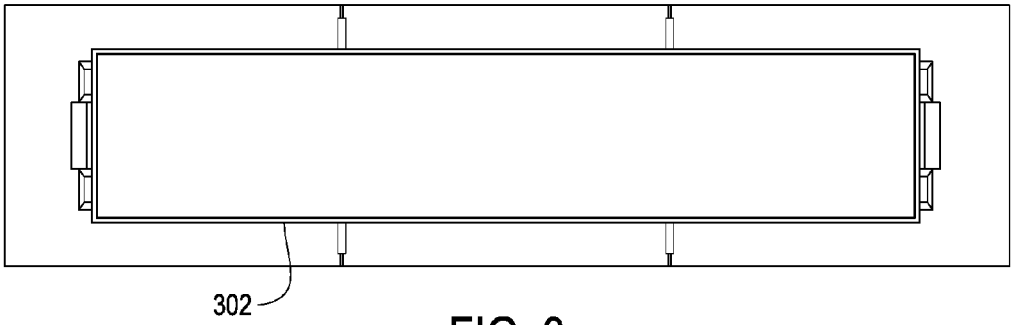
FIG. 3 is a diagram showing dimensions of a payload structure according to some examples.
Figure 4:
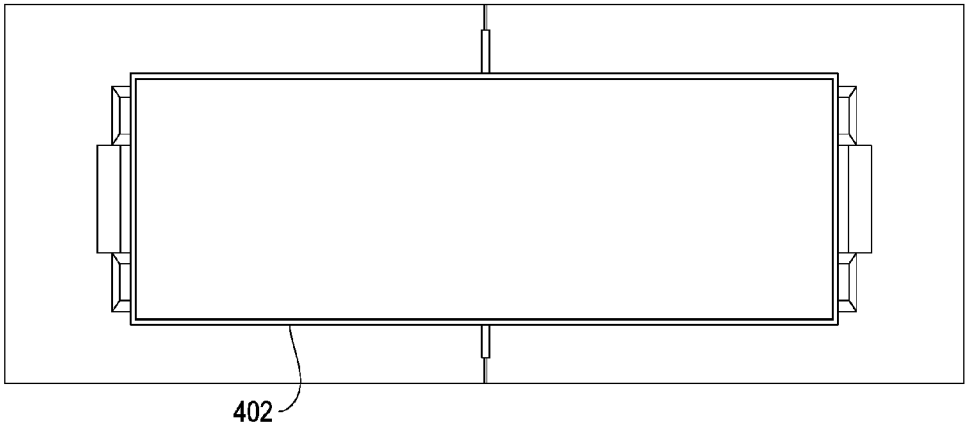
FIG. 4 is a diagram showing dimensions of a payload structure according to some examples.
Figure 5:
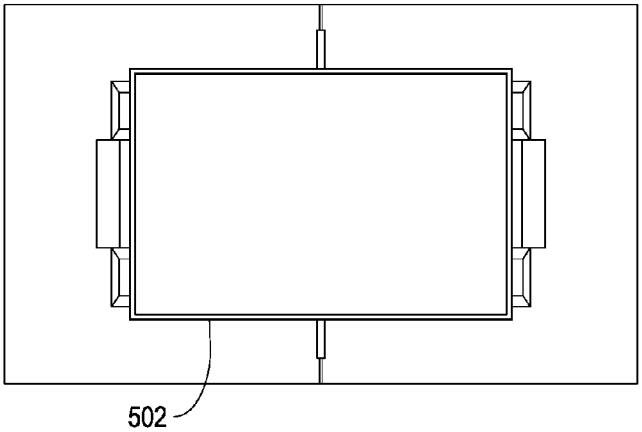
FIG. 5 is a diagram showing dimensions of a payload structure according to some examples.

FIGS. 3-5 show examples of a payload structure for different sizes using a same buoyancy compensation structural tube design. FIG. 3 shows a longer but thinner payload structure 302, while FIG. 4 shows a shorter, but taller payload structure 402. FIG. 5 shows an even shorter and taller payload structure 502, insofar as the payload structure 502 may be substantially square in shape.

Figure 6:
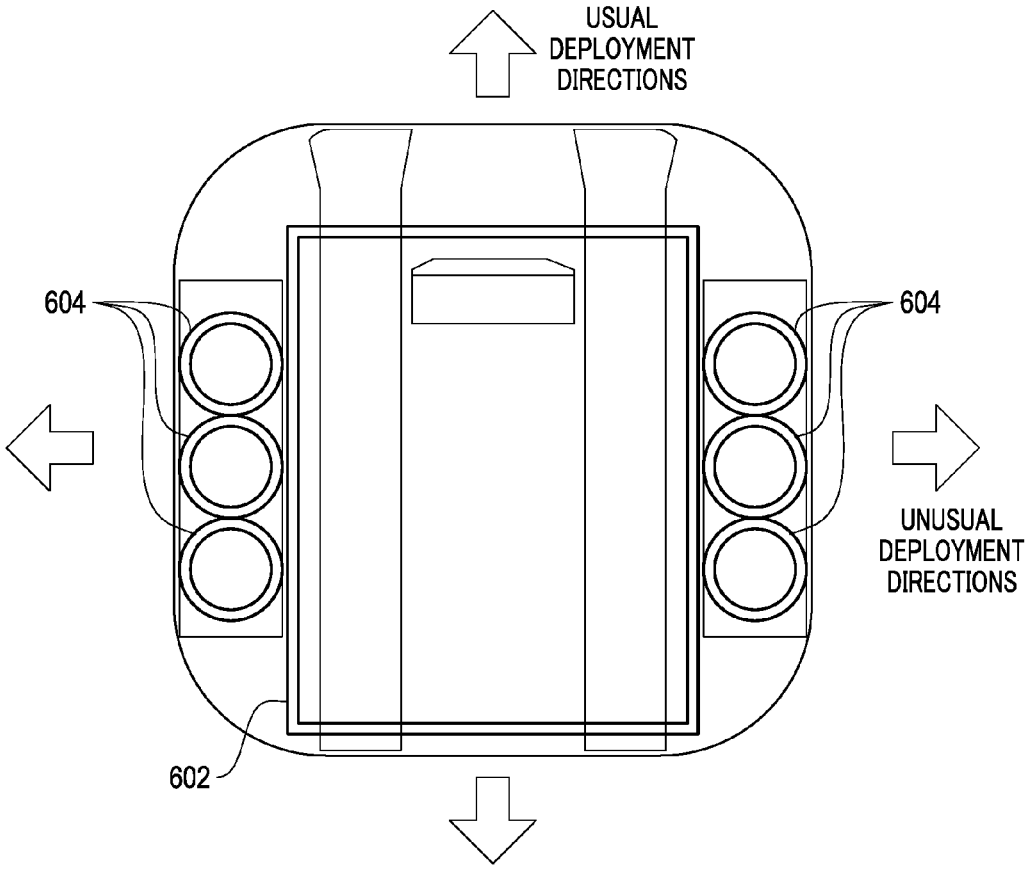
FIG. 6 is a diagram showing a payload structure and deployment directions according to some examples.

As shown in FIG. 6, tubes 604 may be aligned on sides of a payload structure 602. Deployment directions may be toward the top and bottom as shown in FIG. 6. Unusual deployment directions are shown in FIG. 6 as the left and right arrows. In any event, the buoyancy compensation gradient will not only require compensating for a weight loss, but it will also necessitate balancing moments generated by one-time gains and loss of significant weight, such as 1000 or more pounds. The gradient will also be present in a vertical direction.

Additionally, lining the walls of the payload structure with buoyancy compensation structural tubes can carry particular advantages. First, doing so caters to upward/downward falling payload objects, as shown by the upward and downward deployment directions in FIG. 6. Secondly, the presences of the tubes maximizes buoyant moments that might be generated by the tubes (or any other buoyancy compensation device) to balance out large gains/losses of weight as a result of launching payload objects. That is, the tubes may be structured to more easily allow for a buoyancy compensation that can appropriately compensate for the introduction of or removal of payload objects from the payload structure. Additionally, including the tubes as shown can eliminate a large length penalty, as placing buoyancy compensating items and other necessary supporting items forward or aft of the payload object reservation volume increases the length of the structure. Further, the presence of the tubes allows the payload structure to efficiently derive structural stability, trim adjustment, and buoyancy compensation from the same tubular system.

The resulting notional payload structure design is capable of reserving anywhere between 0 and 70% of its volume based on a contiguous cross section along the length of the structure. The maximum reserved cross sectional area for payload objects is ultimately limited by the structural requirements of the vehicle.

In some examples, the plurality of tubes 204 are aligned against each wall 208 of the payload structure 202. That is, one set of tubes 204 is provided along a port edge of the payload structure 202 and another set of tubes 204 is provided along a starboard edge of the payload structure 202. In other examples, the two sets of tubes 204 may be provided along forward and aft ends of the payload structure 202, respectively. In some examples, the payload section 206 that houses an item to be deployed is provided between the two sets of tubes 204. In some examples, the plurality of tubes 204 include nine or more tubes 204 provided within the payload structure 202.

In some embodiments, the tubes 204 form part of the walls 208 of the payload structure 202 and/or the walls of vehicle 100. In other embodiments, the tubes 204 may be integral with the walls 208 of the payload structure 202 and/or walls of the vehicle 100. That is, the outer portion of the tubes 204 may be the outer wall of the payload structure and/or vehicle in some embodiments.

The plurality of tubes 204 may be made of any suitable material. In some examples, aluminum tubes, which may provide for a relatively lightweight material while still providing structural integrity to the payload structure 202, may be used. The plurality of tubes may have different shapes, for example, some may be cylindrical and some may be substantially cylindrical, or some may have a shape other than a cylinder, and the tubes 204 may have different thicknesses.

The plurality of tubes 204 may be provided in any suitable length. However, in some examples, the tubes 204 can be provided in such a manner whereby the tubes 204 extend along the longitudinal ends of the payload structure 202. The tubes 204 can extend the entire length of the payload structure 202, or even beyond the payload structure 202 along the longitudinal ends of the vehicle 100, so as to provide a longitudinal structural stiffness along a total length of the vehicle 100. The plurality of tubes 204 may each be load bearing and contribute to the structural integrity of the vehicle 100. That is, the plurality of tubes 204 can load-bearing, the load-bearing corresponding to a portion of a total structural load of the vehicle. Each of the plurality of tubes 204 may have a same length, diameter and volume capacity as others of the plurality of tubes 204. In other examples, the tubes 204 may have variable lengths, diameters and/or volume capacities so as to conform to the needs of the particular vehicle 100 having the tubes 204. The overall length of the tubes 204 may be developed in consideration of the possible buckling or collapsing of the tubes 204 that could occur prematurely under certain configurations.

The plurality of tubes 204 may be provided with stiffening rings 210 to improve structural integrity and may be machined into the external surface of the tubes 204 so as to allow for the inner wall of the tubes 204 to stay smooth. By utilizing external stiffening rings, the inside of the tubes can be such where trapped volumes of fluid and the like inside the tubes that would otherwise inhibit drainage or fluid flow can be minimized. External stiffening rings 210 may be machined into the tubes 204 and this may avoid extensive internal machining of the tubes. Further, there may exist a single stiffening ring 210 on each tube 204, however, in some examples, a plurality of stiffening rings 210 are provided along a length, or at least a part of a length, of the tubes 204.

Figure 7:
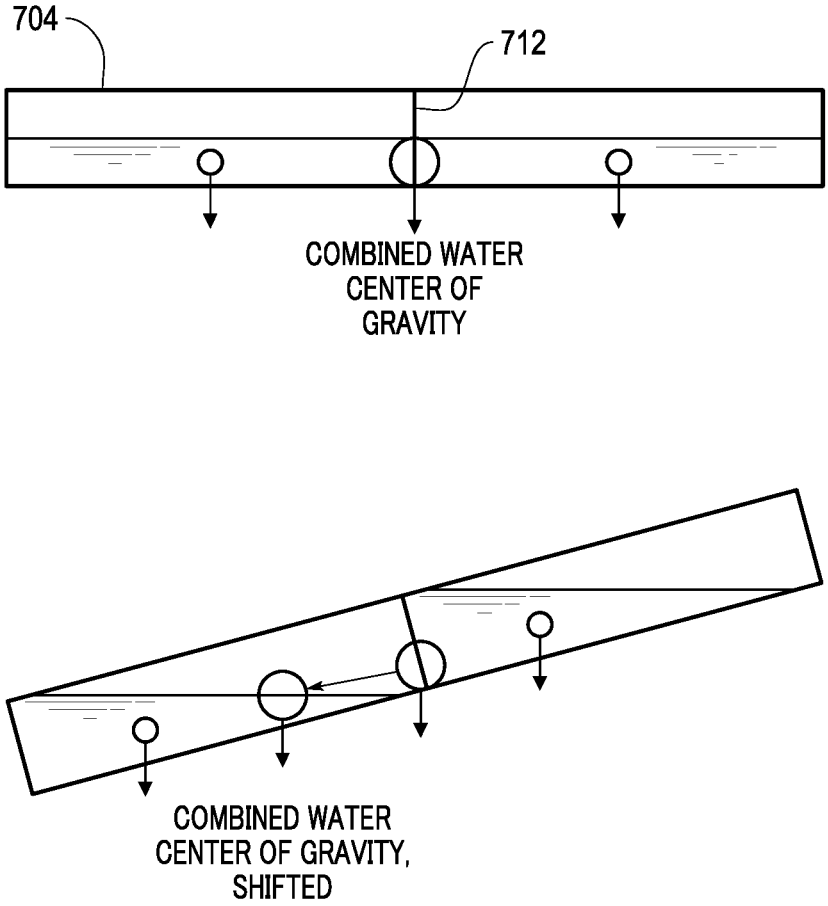
FIG. 7 is a diagram of a payload structure illustrating an operation of baffles according to some examples.

As shown in FIG. 7, baffling 712 may be included in or near some or all of the plurality of tubes 704. The baffling 712 may be provided in the form of one or more flat plates that can have openings at their top portions. The baffling 712 may be positioned between independent areas of the payload structure 202. The baffling 712 may also be positioned in predetermined areas so as to limit a center of gravity shift during a pitch change of the vehicle that houses the payload structure 202. The baffling 712 may be provided so as to minimize sloshing and also to aid in ensuring the pressure in the tubes 704 stays neutralized as the vehicle travels to varying depths. The baffling 712 may particularly allow for a reduction of shift of the center of gravity of the compensation fluid during sustained vehicle pitch excursions.

Figure 8:
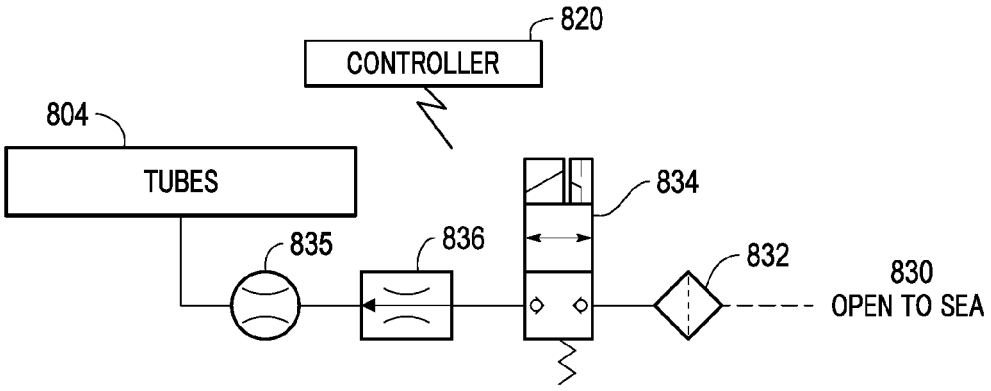
FIG. 8 is a schematic diagram of a flow control system for the payload structure according to some examples.

The plurality of tubes 704 are configured to allow for fluid to flow into the tubes 704. The tubes can be flooded with fluid (for example, water) and increase the payload structure 202 weight when the payload releases an item that is heavy in water. The fluid flow may be controlled by an internal or external controller 820, as shown in FIG. 8, which can be mechanically or electronically configured to provide for a particular fluid flow under a given condition. For example, when an item housed in the payload section 206 is deployed, the controller 820 can mechanically or electronically allow for a flow of fluid from an external location, such as the sea, into the tubes 204 in an amount that neutralizes the weight or mass loss from the deployed item. Similarly, if an item is added (either retrieved from the seawater or elsewhere) so that the total weight or mass of the vehicle is increased, the controller can mechanically or electronically allow for fluid to be removed out of the tubes, and ultimately out to the sea, so that buoyancy is again neutralized. The controller 820 can also be configured to accommodate movement of items along the payload structure or even along the vehicle generally, so as to neutralize buoyancy, for example, by regulating fluid flow to only one side or at least in a nonuniform manner to neutralize a buoyancy change from an item moving from one side to another.

Referring again to FIG. 2, the plurality of tubes 204 may each have individual volumes on one or both sides of the payload structure, so as to provide structural integrity to the payload structure and to allow for fluid compensation volume to be achieved in a variable manner. That is, the tubes 204 themselves may each have a volume that may be in fluid communication with, or not in fluid communication with, others of the tubes in a respective row. Further, some tubes may have inherent within separate sections in fluid communication with each other. The division of the tubes into the individual volumes may further serve to provide trim capability as well as to enable placement of the fluid compensation to more accurately and particularly match the location of the buoyancy change, be it fore-aft, transverse or vertical.

FIG. 8 shows a configuration of the controller 820 that allows for fluid to be transferred into, out of, or between the plurality of tubes 804. In the example of FIG. 4, the controller 820 may allow for fluid, which may be in the form of seawater 830, to be retrieved from an external source, such as the sea. A filter 832 may be provided to filter the fluid to remove any unwanted components. This can prevent the contamination of the hydraulic systems of the vehicle. After passing through the filter 832, a flood valve 834 can be provided. The flood valve 834 may be a normally closed two-way valve, but controlled by the controller 820 to be at least openable so as to allow fluid to pass further through the circuit when appropriate to neutralize buoyancy in the vehicle. A flow control valve 836 can further be regulated by the controller 820 to allow the necessary amount of fluid to pass through the circuit toward the plurality of tubes. The flow control valve 836 prevents unregulated flooding of the tubes 804 since flooding may occur at various depths and pressures. It also ensures that a predetermined, known flow rate will enter the tubes, allowing for predictable system performance. By regulating the flow, the flow control valve also limits the velocity of the fluid in the hydraulic system, thereby preventing line shock (water hammer) when the flood valve 834 is opened or closed.

In some embodiments, a flood valve 834 is not explicitly required, as the flow control valve 836 can work to allow the fluid communication through the system.

A flow meter 835 may also be utilized by the controller 820 so as to monitor the flow into the system. In some embodiments, the flow meter 835 is not required, though its presence in some embodiments may ultimately provide the flow rate for use by the controller 820 so as to ensure a proper compensation quantity of fluid is provided. That is, the controller 820 may calculate a flow rate which will thereby allow the flow control valve 836 and/or flood valve 834 to open or close as appropriate to ensure the appropriate amount of fluid is provided to the plurality of tubes 404.

The plurality of tubes 804 may be in fluid communication with each other or may be without fluid communication with each other, or any combination thereof. In either configuration, the controller 820 can be provided so as to ensure that the appropriate amount of fluid, which may be an amount predetermined by calculations, or otherwise mechanically determined, is provided to each of the plurality of tubes 804 as appropriate. This may properly compensate the vehicle 100 for the change in buoyancy based upon the change in condition of a payload item being deployed, retrieved, or relocated.

A vent valve may be incorporated to vent internal air pressure if compensation is performed in shallow water, or an area where ambient pressure is low, and maximum fill to the plurality of tubes is required.

Figure 9:
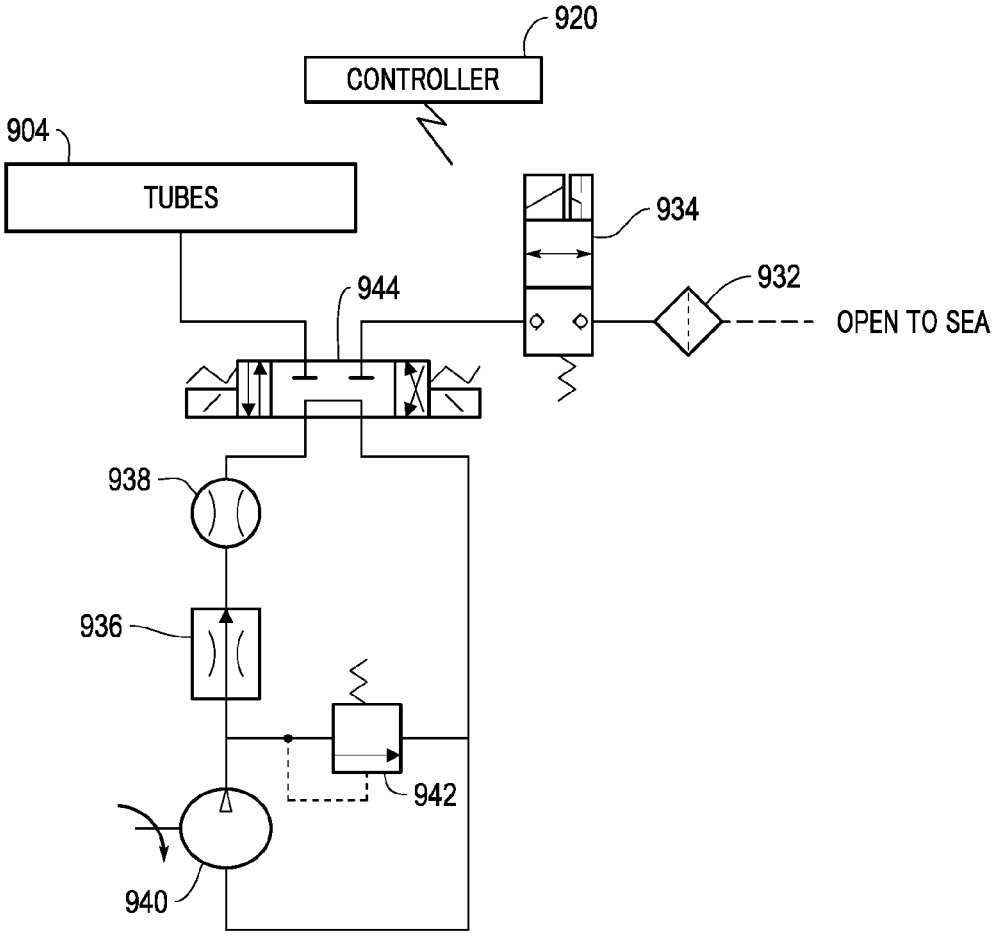
FIG. 9 is a schematic diagram of a flow control system for the payload structure according to some other examples.

FIG. 9 shows an arrangement example of a controller 920 whereby valves additional to those shown in FIG. 8 and pumps are utilized to allow water or any compensation fluid to be pumped away from the plurality of tubes and out of the vehicle. This example may be used in a situation whereby an item has been retrieved and added to the vehicle, and the payload compensation structure, including the amount of fluid in the plurality of tubes 904, must undergo a reduction of fluid so as to compensate for the buoyancy change that occurs from the item being added to the vehicle. A directional control valve 944 may be provided downstream of the plurality of tubes that regulates the direction that the fluid flows. Further, a filter 932, flood valve 934, flow control valve 936 and flow meter 938 can be provided to perform functions similar to the corresponding components described in FIG. 8. A pump 940 may be provided, along with a pressure relief valve 942, to, in conjunction with the flood valve, allow for processing and control of the fluid from the plurality of tubes 904 to the outside of the vehicle. This configuration may allow for the payload structure to become lighter by pumping ballast water out of the tubes 940. This can also be used in conjunction with a flood valve, and can compensate for items that are heavy or light in water.

In some examples, the controller 820, 920 is configured so that an equivalent amount of mass or weight that is lost or added by the change in condition of the vehicle will be provided to the plurality of the tubes. For example, if thirty pounds of weight is removed by a deployed item from the payload section, the controller may allow for thirty pounds of fluid to be added to the tubes. Similarly, if a payload of thirty pounds is added to the payload section from the outside, the controller may allow for thirty pounds of fluid to be removed from the tubes and expelled outside of the vehicle. In any event, it may be desirable to have the center of buoyancy of the vehicle above the center of gravity, and the controller may further consider which tubes to provide or release fluid from to efficiently neutralize the buoyancy of the vehicle. The controller may be set so as to selectively control the flow of fluid to only some, or all, tubes depending on the need to accommodate buoyancy changes. That is, the controller may send fluid to tubes on only one side of the payload structure, or only to fore located tubes, or only to aft located tubes. Further, the tubes may be filled only partially with fluid, or fully with fluid, depending on the amount of fluid determined to be appropriate to accommodate the buoyancy change.

Accordingly, a modular structure that incorporates a plurality of tubes that can provide structural integrity to a payload structure and a vehicle generally can be also used for buoyancy compensation. The configuration of the plurality of tubes, including the location of the plurality of tubes as establishing the payload structure itself, can also allow for a maximum volume to be available for the payloads.

Different examples and aspects of the apparatus and methods are disclosed herein that include a variety of components, features, and functionality. It should be understood that the various examples and aspects of the apparatus and methods disclosed herein may include any of the components, features, and functionality of any of the other examples and aspects of the apparatus and methods disclosed herein in any combination, and all of such possibilities are intended to be within the spirit and scope of the present disclosure.

It is to be understood that the above description is intended to be illustrative, and not restrictive. For example, the above-described examples (and/or aspects thereof) may be used in combination with each other. In addition, many modifications may be made to adapt a particular situation or material to the teachings of the various examples without departing from their scope. While the dimensions and types of materials described herein are intended to define the parameters of the various examples, the examples are by no means limiting and are exemplary examples. Many other examples will be apparent to those of skill in the art upon reviewing the above description. The scope of the various examples should, therefore, be determined with reference to the appended claims, along with the full scope of equivalents to which such claims are entitled.

In the above description, each numerical value should be read once as modified by the term "about" (unless already expressly so modified), and then read again as not so modified unless otherwise indicated in context. Also, in the summary and this detailed description, it should be understood that a range listed or described as being useful, suitable, or the like, is intended to include support for any conceivable sub-range within the range at least because every point within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, (1) even if numerous specific data points within the range are explicitly identified, (2) even if reference is made to a few specific data points within the range, or (3) even when no data points within the range are explicitly identified, it is to be understood (i) that the inventors appreciate and understand that any conceivable data point within the range is to be considered to have been specified, and (ii) that the inventors possessed knowledge of the entire range, each conceivable sub-range within the range, and each conceivable point within the range.

As used herein, the terms "system," "subsystem," "unit," or "module" may include any combination of hardware that operates to perform one or more functions. Thus, for example, one or more of the components may be implemented in a single piece of hardware or multiple pieces of hardware. It should be understood that the various examples are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one example" are not intended to be interpreted as excluding the existence of additional examples that also incorporate the recited features. Moreover, unless explicitly stated to the contrary, examples "comprising" or "having" an element or a plurality of elements having a particular property may include additional such elements not having that property.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, paragraph (f), unless and until such claim limitations expressly use the phrase "means for" followed by a statement of function void of further structure.

This written description uses examples to disclose the various examples, including the best mode, and also to enable any person skilled in the art to practice the various examples, including making and using any devices or systems and performing any incorporated methods. The patentable scope of the various examples is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A buoyancy compensating structure, comprising:

a plurality of tubes forming at least a portion of a payload structure;

a payload section provided within the payload structure, the payload section configured to house a removable payload; and a controller configured to regulate a flow of fluid into the plurality of tubes, wherein the controller is configured to neutralize a buoyancy of the payload structure in response to a change in condition of the removable payload in the payload section.

2. The buoyancy compensating structure according to claim 1, wherein the plurality of tubes are substantially cylindrical in shape.

3. The buoyancy compensating structure according to claim 1, wherein the plurality of tubes are provided in a stacked configuration within the payload structure.

4. The buoyancy compensating structure according to claim 3, wherein the plurality of tubes are provided in a plurality of rows and a plurality of columns within the payload structure.

5. The buoyancy compensating structure according to claim 1, wherein the plurality of tubes are provided along walls of the payload structure.

6. The buoyancy compensating structure according to claim 1, wherein the plurality of tubes comprises a first set of tubes provided along one wall of the payload structure and a second set of tubes provided along an opposite wall of the payload structure.

7. The buoyancy compensating structure according to claim 6, wherein the plurality of tubes are load-bearing, the load-bearing corresponding to a portion of a total structural load of a vessel housing the payload structure.

8. The buoyancy compensating structure according to claim 1, wherein the controller comprises a flow meter that regulates the flow of fluid into the plurality of tubes, the flow meter operating in cooperation with at least one valve that opens and closes so as to regulate the flow of fluid into the plurality of tubes.

9. The buoyancy compensating structure according to claim 1, wherein the controller controls the flow of fluid into each of the plurality of tubes independent of others of the plurality of tubes.

10. The buoyancy compensating structure according to claim 1, wherein the change in condition includes at least part of the removable payload being at least one of removed from, added to, or changed in orientation in the payload section.

11. The buoyancy compensating structure according to claim 10, wherein the payload structure is housed within a vessel, the vessel disposed within a body of water, the controller provided with a system allowing for water directly from the body of water to be provided to the plurality of tubes.

12. The buoyancy compensating structure according to claim 11, wherein the plurality of tubes are provided along longitudinal ends of the vessel and are configured to provide longitudinal structural stiffness along a total length of the vessel.

13. The buoyancy compensating structure according to claim 1, wherein the payload structure further comprises baffling, the baffling disposed between independent areas of the payload structure.

14. The buoyancy compensating structure according to claim 1, wherein baffling are positioned in predetermined areas so as to limit at least one of a center of gravity shift or pitch change of a vessel housing the payload structure.

15. The buoyancy compensating structure according to claim 1, wherein the plurality of tubes comprise a stiffening ring provided on an outside of the tubes, and an inside of the plurality of tubes is comprised of a smooth material.

16. The buoyancy compensating structure according to claim 1, wherein the plurality of tubes are in fluid communication with each other.

17. A buoyancy compensating structure provided in a payload structure of a marine vessel, the buoyancy compensating structure comprising:

a plurality of substantially cylindrical tubes provided on opposing walls of the payload structure;

a flow control system comprising a flow meter and at least one valve, wherein the flow control system is operable to add and remove seawater to the plurality of substantially cylindrical tubes; and a payload section, wherein, when a mass or weight distribution of the payload section changes, the flow control system operates so as to adjust the buoyancy of the payload structure to a predetermined level.

18. A method for compensating buoyancy of a payload structure of a marine vessel, comprising:

regulating, by means of a controller, a flow of fluid into a plurality of tubes forming at least a portion of the payload structure, wherein the controller is configured to neutralize a buoyancy of the payload structure in response to a change in condition of a removable payload housed in a payload section of the payload structure.

19. The method according to claim 18, wherein the controller controls the flow of fluid into each of the plurality of tubes independent of others of the plurality of tubes.

20. The method according to claim 18, wherein the change in condition includes at least part of the removable payload being at least one of removed from, added to, or changed in orientation in the payload section.

* * * * *